US007602336B2

(12) United States Patent
Dybdal et al.

(10) Patent No.: US 7,602,336 B2
(45) Date of Patent: Oct. 13, 2009

(54) COHERENTLY COMBINING ANTENNAS

(75) Inventors: Robert B. Dybdal, Palos Verdes Estates, CA (US); Samuel J. Curry, Redondo Beach, CA (US)

(73) Assignee: The Aerospace Corporation, El Segundo, CA (US)

( * ) Notice: Subject to any disclaimer, the term of this patent is extended or adjusted under 35 U.S.C. 154(b) by 0 days.

(21) Appl. No.: 11/761,348

(22) Filed: Jun. 11, 2007

(65) Prior Publication Data

US 2008/0303742 A1 Dec. 11, 2008

(51) Int. Cl.
*H01Q 3/00* (2006.01)

(52) U.S. Cl. ..... 342/372; 342/375

(58) Field of Classification Search ..... 342/368, 342/372, 375; 375/137, 138, 150; 380/268; 343/893

See application file for complete search history.

(56) References Cited

U.S. PATENT DOCUMENTS

| | | | | |
|---|---|---|---|---|
| 4,334,314 | A * | 6/1982 | Nard et al. | 375/362 |
| 5,428,814 | A | 6/1995 | Mort et al. | |
| 5,583,516 | A | 12/1996 | Lembo | |
| H1625 | H | 1/1997 | Frankel | |
| 5,623,360 | A | 4/1997 | Gesell et al. | |
| 5,796,510 | A | 8/1998 | Yao | |
| 5,978,125 | A | 11/1999 | Yao | |
| 6,580,497 | B1 * | 6/2003 | Asaka et al. | 356/28.5 |
| 6,760,512 | B2 | 7/2004 | Pepper | |
| 6,818,144 | B1 | 11/2004 | Tidrow et al. | |
| 6,850,557 | B1 * | 2/2005 | Gronemeyer | 375/150 |
| 6,875,369 | B1 | 4/2005 | Tidrow et al. | |
| RE38,735 | E | 5/2005 | Yao | |
| RE38,809 | E | 10/2005 | Yao | |
| 2004/0190597 | A1 * | 9/2004 | Cowie et al. | 375/138 |

OTHER PUBLICATIONS

J.C. Sethares, "Magnetostatic Wave Devices and Applications," J. Appl. Phys., 53 (3) Mar. 1982, pp. 2646-2651.

K. M. SooHoo and R. B. Dybdal, "Tolerances for Combining High Gain Antennas," 1994 IEEE AP-S Symposium Digest, Seattle WA pp. 209 212, Jun. 19 24, 1994.

R. B. Dybdal and K. M. SooHoo, "Arraying High Gain Antennas," 2000 IEEE AP-S Symposium Digest, Salt Lake City UT, pp. 198-201, Jul. 16-21, 2000.

* cited by examiner

*Primary Examiner*—Dao L Phan
(74) *Attorney, Agent, or Firm*—Henricks, Slavin & Holmes LLP

(57) ABSTRACT

An apparatus includes antenna elements configured to receive a signal including pseudo-random code, and electronics configured to use the pseudo-random code to determine time delays of signals incident upon the antenna elements and to compensate the signals to coherently combine the antenna elements.

14 Claims, 3 Drawing Sheets

COMPENSATION CIRCUITRY

COHERENTLY COMBINING ANTENNAS

STATEMENT OF GOVERNMENT INTEREST

The invention was made with Government support under JPL Contract No. 1260512, a subcontract under prime contract NAS7-03001 awarded by NASA. The Government has certain rights in the invention.

TECHNICAL FIELD

The invention relates generally to antennas and, in particular, to using a code to coherently combining a large number of antenna elements.

BACKGROUND ART

The capability of a receiving system to receive low level signals is limited by the ratio (G/T) of the receiving antenna, where (G) is antenna gain and (T) is system noise temperature. While much progress has been made in low noise receiver technology, applications exist in which the antenna gain (G) becomes the limiting factor.

Large high gain antennas are expensive. One alternative to a single high gain antenna is to coherently combine a number of smaller antennas to attempt to achieve comparable performance. In theory, the gain of a coherently combined array of N antennas equals N times the gain of a single antenna element assuming each antenna in the collection has identical characteristics. However, a challenge of this alternative array approach is that the antenna elements must be coherently combined to achieve the desired gain performance.

The coherent combination of multiple antennas has requirements to properly compensate for the differences in arrival time of the signals at each antenna element and to compensate for the insertion phase differences among the individual antenna elements. Past work has identified the required tolerances in such coherent combining and these tolerances depend on the bandwidth of the signals. See, K. M. SooHoo and R. B. Dybdal, "Tolerances for Combining High Gain Antennas," 1994 *IEEE AP-S Symposium Digest*, Seattle Wash. pp 209-212, Jun. 19-24, 1994; R. B. Dybdal and K. M. SooHoo, "Arraying High Gain Antennas," 2000 *IEEE AP-S Symposium Digest,* Salt Lake City Utah, pp 198-201, Jul. 16-21, 2000.

It would be helpful to be able to provide a method for coherently combining the individual antennas in an array with a large number of antenna elements, in particular in cases where a relatively large bandwidth is required.

SUMMARY OF THE INVENTION

Embodiments described herein involve providing wide bandwidth coherent combination of a large number of high gain antennas, providing a simple means of producing the necessary time delay and phase compensations, addressing Built In Test Equipment (BITE) capabilities for diagnostics and array adjustments, and/or obtaining the necessary array alignment in a timely manner. Further, embodiments described herein advantageously protect the necessary correlation processing from local interfering signals.

Embodiments described herein involve transmitting a wide bandwidth pseudo random calibration code from the signal source. When processed, this signal provides an adequate S/N ratio at each antenna element and the differences in the time delay values to provide the necessary time delay compensation. The desired data signal from the source can be transmitted separately or modulated onto the calibration code. Other features of embodiments described herein include the incorporation of calibration features into the array to allow compensation for amplitude and phase imperfections of the array. These features provide not only a means of calibrating the array elements but also BITE for diagnostics. In embodiments described herein, the signals from the individual array elements are corrected for amplitude and phase imperfections and digitally delayed using fixed and variable true time delay and summed. The correlation levels of the individual antenna elements and their summed output with a replica of the calibration code provide measures of the combining efficiency of the array processing.

In an example embodiment, an apparatus includes antenna elements configured to receive a signal including pseudo-random code, and electronics configured to use the pseudo-random code to determine time delays of signals incident upon the antenna elements and to compensate the signals to coherently combine the antenna elements.

DISCLOSURE OF INVENTION

Figure 1:
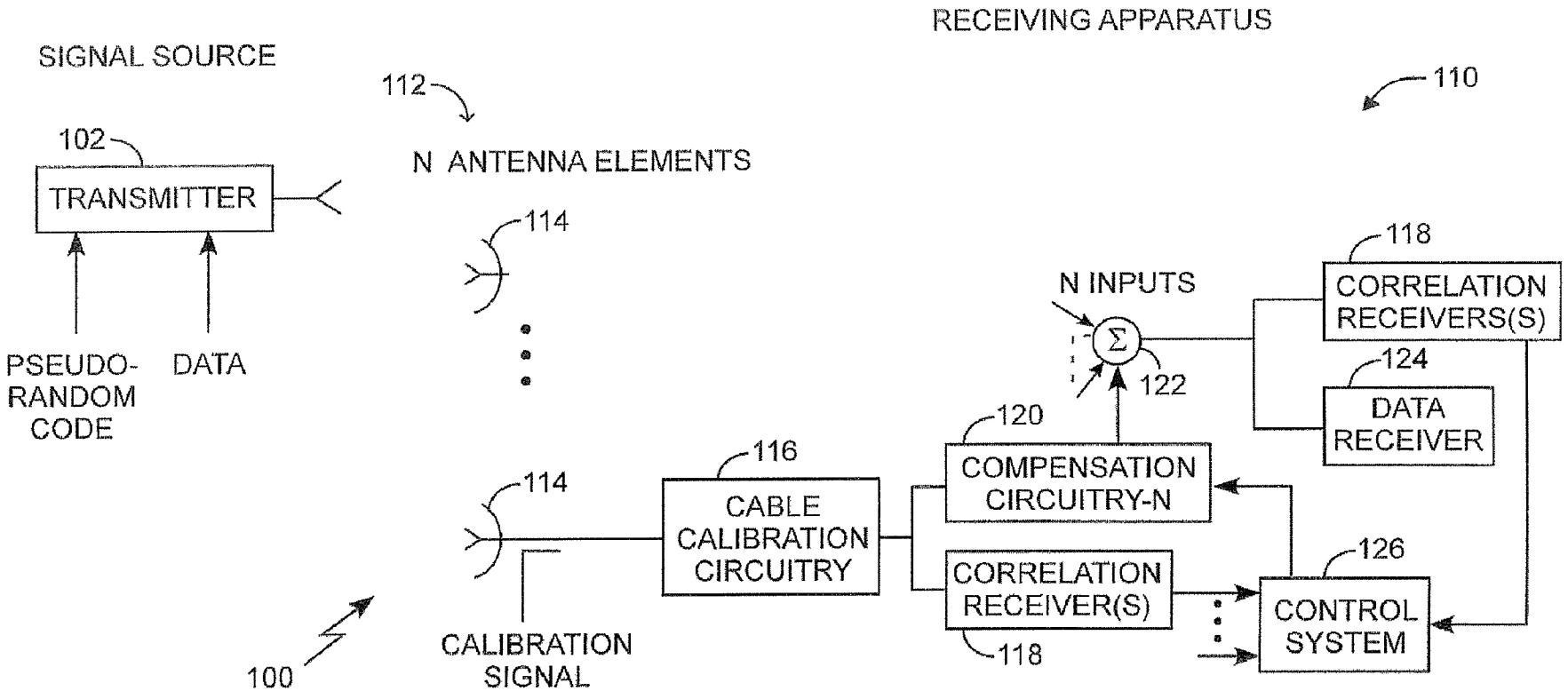
FIG. 1 is a functional diagram of an example embodiment of a system for coherently combining antennas.

Referring to FIG. 1, in an example embodiment, a system 100 for coherently combining antennas includes a signal source 102 and a receiving apparatus 110. The signal source 102 is a transmitter which, for example, transmits signals communicating pseudo-random code and data. The pseudo-random code can be a calibration code or a ranging code. The receiving apparatus 110 includes an array 112 of N antenna elements 114. By way of example, the N antenna elements 114 can be provided in a linear arrangement, a Y-shaped configuration, or in other geometries. In this example embodiment, the receiving apparatus 110 includes cable calibration circuitry 116, correlation receiver(s) 118 to determine time delays, N compensation circuitry 120 to allow time delay, amplitude, and phase adjustment, a summer 122 for the antenna elements, a data receiver 124, and a control system 126, configured as shown.

With regard to the tolerances for coherently combining antennas, the individual antennas must be separated sufficiently to avoid physical blockage, and the received signal has different time delays at each antenna that must be compensated. For wide bandwidth signals, time delay compensation must be used. The combining requirements for two antennas are addressed to determine the combining tolerance requirements. If two antennas are coherently combined, their combining efficiency is given by $$C(\theta,\omega)=2\,[\cos\{[(\omega(S/c)\sin\theta-\tau)-\alpha]/2\}]^2$$

where $\theta$ is the signal direction and S is the separation (baseline) between antenna elements, $\omega$ is the radian frequency, $\tau$ and $\alpha$ are the time delay adjustment and insertion phase differences between the antenna elements. The tolerances in these adjustments can be expressed in terms of the uncompensated time delay $\Delta\tau=(S/c)\sin\theta-\tau$ and uncompensated phase $\delta\phi=\omega_o\Delta\tau-\alpha$ at the center frequency. With these definitions, the combining efficiency then becomes $$C=1+\cos(\delta\omega\Delta\tau+\delta\phi)$$

where the radian frequency has been expanded about the center frequency as $\omega=\omega_o+\delta\omega$. Ideal combining requires $\tau=(S/c)\sin\theta$ and $\alpha=0°$. When two antennas are ideally combined, the combining efficiency is doubled and the S/N increases by a factor of 2 (3 dB) as is well known.

For a finite bandwidth signal, the combining efficiency can be integrated over the bandwidth and dividing by that bandwidth [See, K. M. SooHoo and R. B. Dybdal, "Tolerances for Combining High Gain Antennas," 1994 *IEEE AP-S Symposium Digest*, Seattle Wash. pp 209-212, Jun. 19-24, 1994; R. B. Dybdal and K. M. SooHoo, "Arraying High Gain Antennas," 2000 *IEEE AP-S Symposium Digest*, Salt Lake City Utah, pp 198-201, Jul. 16-21, 2000, both of which are incorporated herein by reference] yielding the average combining efficiency $$C_{ave}=1+(\sin X/X)\cos\delta\phi$$

where $X=\pi BW\Delta\tau$. The average combining efficiency depends on the uncompensated time delay and phase. Tolerances for such compensation can be obtained from this expression. The uncompensated time delay limits the value of X and the phase at the center frequency between elements must be adjusted. Practical combining applications require a quick reliable means to determine the required time delay and phase compensation.

Embodiments described herein involve coherently combining a large number of high gain antennas to increase the sensitivity of a receiving antenna system. The challenge in this application is to provide the necessary time delay and phase compensation among the individual array elements to maximize the received signal level. Embodiments described herein achieve this by aligning the array using a wideband pseudo random calibration code transmitted by the source and utilizing calibration features incorporated into the antenna element's design.

Referring again to FIG. 1, in an example embodiment, the signal source 102 transmits a wide bandwidth calibration code and the data signal. The calibration code is spread over a wide bandwidth that exceeds the bandwidth of the data signal and is transmitted at a low level. For example, a bandwidth of 1 GHz, detection to within 1/10 of a chip, and waveform weighting yields a range resolution of about 1.5". The processing gain of this waveform allows detection of the calibration code at each antenna element 114 without incurring a significant transmitter power requirement relative to the power needed for the data signal. This ranging signal provides a means of antenna tracking alignment of the individual antenna elements 114, and the output of each element provides a diagnostic capability by examination of the received signal strengths for each element in the array 112. This calibration code can also be processed to yield the carrier component providing Doppler estimates for the received signal and assist acquisition of the data signal.

In an example embodiment, the signal source 102 transmits a low level pseudo-random coded signal for purposes of aligning the array 112. The processing gain of such a code is sufficient to allow adjustment of an individual array element 114 both in terms of its pointing and time delay. The carrier of this coded signal also allows Doppler measurements.

As noted above, the receiving array 112 includes N antenna elements 114. The signal direction and the array geometry can be used to obtain rough estimates of the differences in the signal arrival times at each element 114. In an example embodiment, these signal delay estimates are used to determine first order estimates of the delay components. In an example embodiment, the time delay differences at each of the antenna elements 114 are compensated for with fixed delay components and variable true time delay components (e.g., implemented by magnetostatic wave technology). A calibration signal is injected at each antenna element 114 and provides the means to measure the insertion gain and phase of each receiver 118. Differences in the insertion gain together with the capability to adjust the gain provide estimates of the required phase compensation and amplitude alignment. For example, if the antenna gain and the system noise temperature of the N antennas 114 are equal, the signal combining should have equal amplitudes to maximize the array output; if a mixture of receiving element characteristics is used in the array, the combining should weight the outputs dependent on the individual antenna S/N, where S is the received signal power at that individual antenna element. If the elements are identical, the outputs of the calibration code signal should be identical for each element. Unequal outputs indicated either antenna tracking errors or degradation of the receiver electronics. The calibration code detection provides BITE capabilities and the calibration code signal can also be used for antenna tracking. Each antenna element 114 also contains compensation circuitry 120 to adjust the amplitude, phase, and differential delays of each antenna element 114. This adjustment is provided through measurements performed by the calibration code signal processing in the correlation receiver 118 and by the calibration signal. These adjustments correct the insertion gain and phase of the individual antenna elements 114 and provide delay compensation for the separated antenna elements 114.

The output of each antenna element 114 is summed by the summer 122 to produce the array output. In an example embodiment, equal delay fiber optics lines connect the individual antennas 114 to a central location; fiber optics can also be used to transfer the necessary reference frequency for frequency downconversion to IF (e.g., performed by the cable calibration circuitry 116) at each antenna element 114. The procedure thus far provides a nominal alignment of the antenna array 112 that is subsequently adjusted by measurements performed by the correlation receiver(s) 118 in the central location.

The alignment of the array 112 at the central location is performed in the following manner. The correlation receiver (s) 118 provides both a correlation output and an estimate of the carrier frequency as described above. The nominal alignment described above for each antenna element 114 is further adjusted based on the measured combining efficiency. The nominal alignment also produces measurements of the calibration code's S/N.

One means of aligning the array for narrow bandwidth applications examines the central location correlation receiver output for pairs of antenna elements. If the output correlation level increases by 3 dB, the pairs are aligned. If the output remains the same or higher, the phase error is 90° or less; adding and subtracting 90° of phase shift in the compensation circuitry 120 resolves this issue and the output level of the central location correlator receiver 118 is varied to obtain a 3 dB increase compared with a single antenna. If the signal level is less than that of a single element, the phase error is between 90° and 270°, and the addition of a 180° phase shift reduces the problem to the former case. After adjustment, the addition and subtraction of 90° phase shifts and central correlation outputs that are equal and identical to a single antenna element validates correct alignment. The process is repeated through the number of elements in the array. Alternatively, additional correlation receivers can be used in a parallel rather than serial pairwise alignment of the element combining to reduce the time required to align the individual antenna elements at the summation at the expense of additional circuitry.

For wider bandwidth applications, the time delay values may require change. In this case, the above alignment procedure is repeated at the center frequency using the carrier power. The phase shift is comprised of both uncompensated phase and delay. The combining efficiency is then measured at equal and opposite frequency changes using the correlator output. If the combining loss is the same at both frequencies, the time delay is adequately compensated. If not, the differences in the levels may be used to determine the uncompensated time delay value. The time delay and phase corrections are then determined. This process is again repeated until all antenna elements are aligned.

In operation, test signals are used to calibrate the electronics in the antenna array. This calibration includes the insertion gain and phase characteristics and the compensation circuitry 120 is initially set to maintain the same response at each element 114. In an example embodiment, fiber optics technology is used to connect the array elements 114, and their delay characteristics are separately measured. The array geometry and the signal direction provide first order estimates for the required time delay values that are subsequently refined. These first order estimates are used to initially adjust the time delays in the individual array elements 114. In an example embodiment, the time delay compensation includes fixed fiber delays and variable true time delay technology. The time delay provided by the fixed delay values can be implemented by time shift modules following the architecture in J. J. Lee, R. Y. Loo, S. Livingston, V. J. Jones, J. B. Lewis, H. W. Yen, G. L. Tangonan, and M. Wechsberg, "Photonic Wideband Array Antennas," *IEEE Trans Antennas and Propagation AP*-43, pp 966-982, September 1995, incorporated herein by reference. Variable true time delay technology provides a vernier variation of the time delay.

Figure 2:
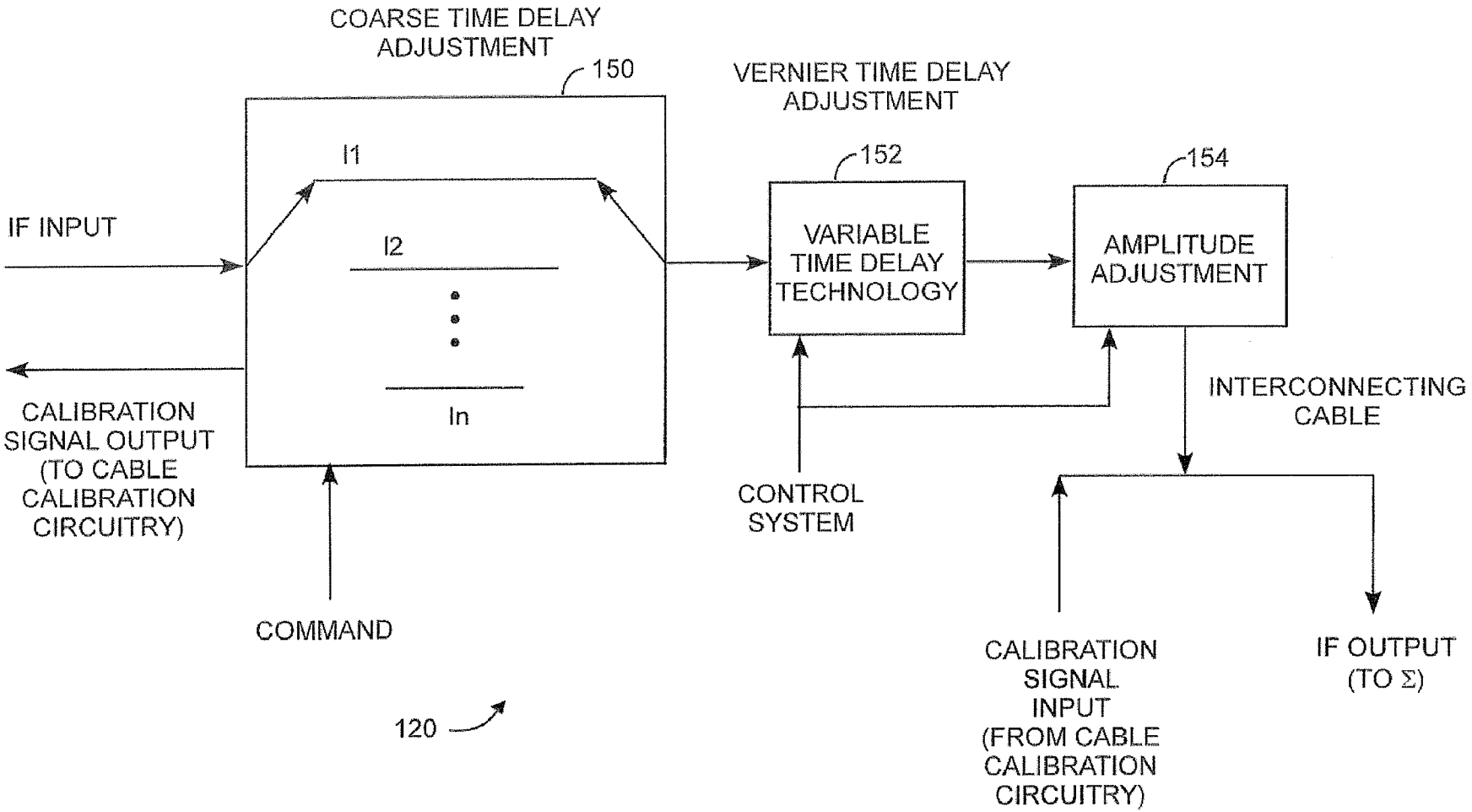
FIG. 2 is a functional diagram of an example embodiment of the compensation circuitry for the system of FIG. 1.

Referring to FIG. 2, in an example embodiment, the compensation circuitry 120 includes a coarse time delay adjustment element 150, a vernier time delay adjustment element 152, and an amplitude adjustment element 154, configured as shown. In an example embodiment, the coarse time delay adjustment element 150 includes fiber optic elements of differing lengths, l1-In, and switches and switching control electronics (not shown), which set the coarse time delay based on the a priori direction of the signal verified. The switching control electronics determine the input denoted "Command", which controls the switches to select an appropriate coarse delay. In another example embodiment, the vernier time delay adjustment element 152 includes piezoelectric devices which are used to vary time delay. The vernier time delay adjustment element 152 and the amplitude adjustment element 154 receive control inputs from the control system 126, with the amplitude adjustment element 154 weighting the amplitudes as a function of received S/N. As shown, the compensation circuitry 120 receives both an IF input and a calibration signal input from the cable calibration circuitry 116. The calibration circuitry 116, in turn, receives a calibration signal output from the compensation circuitry 120.

After the electronics in the individual antenna elements 114 have been calibrated, the time delay and amplitudes of the interconnecting cables have been determined, and the initial time delays based on geometry have been set, the transmitted coded signal is measured. The antenna pointing of each antenna element 114 is performed, the output S/N of each element 114 is measured, and their relative time delay differences are adjusted with the element compensation circuitry 120. These steps provide a BITE capability of the elements 114. If the elements 114 are identical, the S/N values should be the same. If the array 112 is comprised of different element characteristics, the S/N values should follow the expected a priori distribution.

Recall the objective of this array alignment is to make the X term in the average combining efficiency small. If correlation were performed using the data signal, the resolution in time delay from such a correlation process is 1/BW where BW is again the data signal bandwidth. If the uncompensated time delay is this time delay resolution value, then $X=\pi$ and the average combining efficiency becomes 1, that is, combining antennas provides no advantages as averaged over the bandwidth. By contrast, with the pseudo random calibration code, the time delay resolution is greatly improved. The resolution of the time is $\frac{1}{10}B$ where B is the code bandwidth. As an example, suppose B is 5 times BW. If the uncompensated time delay is again the time delay resolution value for the coded signal, the value of X is $\pi/50$ and the sin X/X value is exceedingly close to 1. With proper phase compensation at the center frequency, the combining efficiency should be close to its ideal value.

After this alignment of each antenna element and interconnecting cables, the signals are combined at the central array location and the uncompensated phase at the center frequency is adjusted. In an example embodiment, this adjustment uses the carrier frequency derived from the correlation receiver 118 at the array output. The uncompensated phase results from the residual uncompensated time delay and the insertion phase differences in the individual antenna channels. Individual antenna pairs are selected at the summing switch and the carrier power output is compared. The combined carrier output should result in a carrier power increase, the same carrier power level, or a decreased carrier power level. If the carrier power increases, the uncompensated phase error is less than 90° and the magnitude may be estimated roughly by the increase. This estimated phase error can then be added and subtracted from the antenna element being combined and the differences in these power measurements yield the required phase correction. This phase correction when applied can be verified by applying equal and opposite phase values, e.g. 45°, and if correct, the combined power should be equal at each phase setting. By contrast, if the carrier power decreases when the elements are combined, the phase error exceeds 180°, and an 180° phase shift reduces the problem to the case discussed.

In an example embodiment, correlation techniques are also used after antenna element combining. Both correlation with the known code and cross correlation between antenna element pairs indicate time offsets from either misadjustment of the antenna element and/or calibration errors in the group delay values of the fiber optics interconnections of the array antenna elements. The shape of the cross correlation of element pairs is also distorted from phase and time delay imperfections. Thus, the correlation processing when antenna elements are combined provides diagnostic insight to the coherent combination of antenna elements.

This process is continued throughout the array until the phase is compensated for all array elements. In practice, the time required for the phase alignment can be reduced if multiple correlation receivers 118 are used. In an example embodiment, the array alignment is performed with a satellite transmitting only the low power calibration code. After calibration is assured, the satellite can be commanded to transmit the data signal. The calibration code would also be transmitted allowing the alignment to be monitored during data transmission. Depending on the data rates, the data signal can be added to the calibration code. Alternatively, the data and calibration code can be independently transmitted because it is believed that the code transmission has a power level that is sufficiently low to not interfere with the data signal. Using a common frequency reference for the code and data signal can simplify the acquisition of the data signal.

Figure 3:
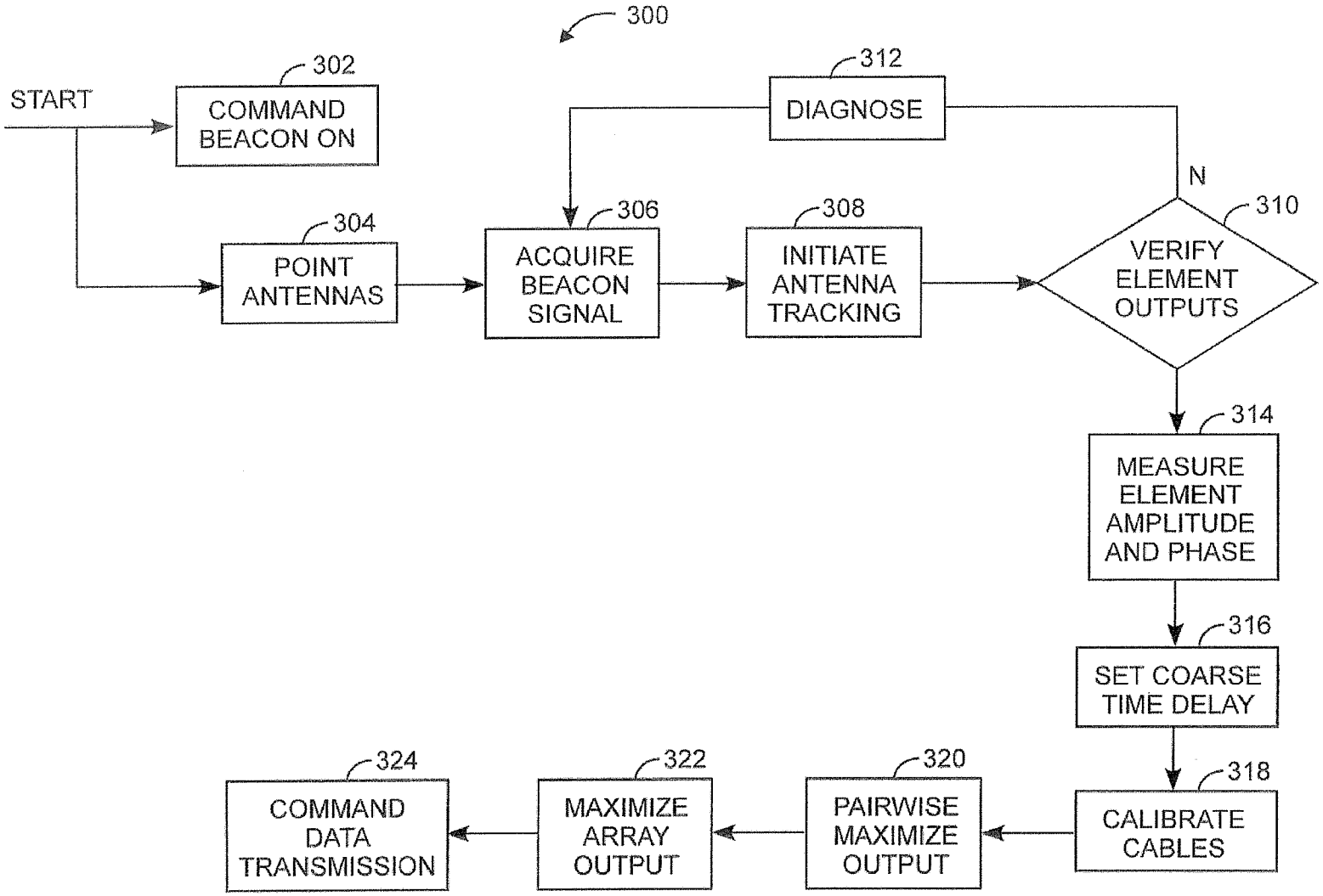
FIG. 3 is a flow diagram of an example process of coherently combining antennas.

FIG. 3 is a flow diagram of an example method 300 for coherently combining antennas. The process for aligning the antenna elements for coherent combining begins at 302 where a command is sent to turn on the beacon transmitter at the satellite. At 304, the individual array antennas are commanded to point in the nominal signal direction. At 306, the array element correlation receivers receive the beacon signal. At 308, the received beacon signal allows the antenna autotrack to function and the individual array elements track on the beacon signal to refine the original nominal pointing direction. At 310, it is determined whether the output levels of the correlation receivers on each antenna element have similar levels; if not, at 312, the reason for dissimilarity is diagnosed. At 314, the individual antenna element calibration source is used to measure the amplitude and phase response of the individual array elements that is compensated at the element level to offset the electronics drift. At 316-318, the coarse time delay is set based on the a priori direction of the signal verified by the antenna pointing data and compensated for any cable variations derived from their calibration. At 320, the next step is to pairwise combine array outputs and adjust circuitry, e.g., to obtain a 3 dB S/N increase in beacon power. At 322, the element pairs are combined in the same fashion again using the output correlation receiver to adjust as needed to provide the expected S/N increase in beacon power. Having completed the array alignment using the satellite beacon, at 324, the satellite is commanded to begin transmitting data. Using the beacon signal, the beacon power levels can be monitored during data reception to compensate for any system drift.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. An apparatus comprising:

antenna elements configured to receive a signal including pseudo-random code;

electronics configured to use the pseudo-random code to determine time delays of signals incident upon the antenna elements and to compensate the signals to coherently combine the antenna elements.

2. The apparatus of claim 1, wherein the electronics include compensation circuitry configured to provide fixed time delay adjustments to signals received by the antenna elements.

3. The apparatus of claim 2, wherein the compensation circuitry includes fiber optics components differing in length.

4. The apparatus of claim 2, wherein the fixed time delay adjustments are each determined based on an a priori direction of a signal verified by antenna pointing data.

5. The apparatus of claim 1, wherein the electronics include compensation circuitry configured to provide vernier time delay adjustments to signals received by the antenna elements.

6. The apparatus of claim 5, wherein the compensation circuitry includes variable true time delay components.

7. The apparatus of claim 5, wherein the compensation circuitry includes magnetostatic wave technology.

8. The apparatus of claim 5, wherein the compensation circuitry includes a piezoelectric device.

9. The apparatus of claim 1, wherein the electronics include compensation circuitry configured to provide amplitude adjustments to signals received by the antenna elements.

10. The apparatus of claim 1, wherein the electronics include one or more correlation receivers configured to determine time delays for signals received by the antenna elements.

11. The apparatus of claim 10, wherein the electronics are configured to receive a calibration signal injected at each of the antenna elements for measuring insertion gain and phase for each of the correlation receivers.

12. The apparatus of claim 10, wherein the electronics are configured to subsequently adjust a nominal alignment of the antenna elements using measurements performed by the correlation receivers.

13. The apparatus of claim 12, wherein the measurements are performed at a central location among the antenna elements.

14. The apparatus of claim 10, wherein the electronics include a summer for combining the signals received by the antenna elements, and the correlation receivers are configured to process the signals both prior to and after the signals are combined by the summer.

* * * * *